US009215770B2

(12) United States Patent
Mazumdar et al.

(10) Patent No.: US 9,215,770 B2
(45) Date of Patent: Dec. 15, 2015

(54) SYSTEMS AND METHODS FOR LOW-POWER LAMP COMPATIBILITY WITH A TRAILING-EDGE DIMMER AND AN ELECTRONIC TRANSFORMER

(71) Applicant: Cirrus Logic, Inc., Austin, TX (US)

(72) Inventors: Poornima Mazumdar, Austin, TX (US); Michael A. Kost, Austin, TX (US); Yanhui Xie, Austin, TX (US); Sahil Singh, Austin, TX (US)

(73) Assignee: Philips International, B.V., Eindhoven (NL)

( * ) Notice: Subject to any disclaimer, the term of this patent is extended or adjusted under 35 U.S.C. 154(b) by 62 days.

(21) Appl. No.: 14/039,355

(22) Filed: Sep. 27, 2013

(65) Prior Publication Data

US 2014/0028214 A1 Jan. 30, 2014

Related U.S. Application Data

(63) Continuation-in-part of application No. 13/798,926, filed on Mar. 13, 2013.

(60) Provisional application No. 61/667,685, filed on Jul. 3, 2012, provisional application No. 61/673,111, filed on Jul. 18, 2012, provisional application No. 61/826,250, filed on May 22, 2013.

(51) Int. Cl.
*H05B 37/02* (2006.01)
*H05B 33/08* (2006.01)

(52) U.S. Cl.
CPC ..... *H05B 33/0818* (2013.01); *H05B 33/0815* (2013.01)

(58) Field of Classification Search
USPC ..... 315/209 R, 276, 291, 307, 308
See application file for complete search history.

(56) References Cited

U.S. PATENT DOCUMENTS 3,806,829 A * 4/1974 Duston et al. ..... 372/38.01
4,008,414 A 2/1977 Agnew (Continued)

FOREIGN PATENT DOCUMENTS

EP 2403120 A2 1/2012
EP 2590477 A1 5/2013

(Continued)

OTHER PUBLICATIONS

International Search Report and Written Opinion, International Patent Application No. PCT/US2013/047777, mailed Jun. 26, 2014, 21 pages.

(Continued)

*Primary Examiner* — Brandon S Cole
(74) *Attorney, Agent, or Firm* — Jackson Walker L.L.P.

(57) ABSTRACT

A controller may be configured to: (i) predict based on an electronic transformer secondary signal an estimated occurrence of a high-resistance state of a trailing-edge dimmer coupled to a primary winding of an electronic transformer, wherein the high-resistance state occurs when the trailing-edge dimmer begins phase-cutting an alternating current voltage signal; (ii) operate a power converter in a trailing-edge exposure mode for a first period of time immediately prior to the estimated occurrence of the high-resistance state, such that the power converter is enabled to transfer energy from the secondary winding to the load during the trailing-edge exposure mode; and (iii) operate the power converter in a power mode for a second period of time prior to and non-contiguous with the first period of time, such that the power converter is enabled to transfer energy from the secondary winding to the load during the power mode.

26 Claims, 6 Drawing Sheets

(56) References Cited

U.S. PATENT DOCUMENTS

| | | | | |
|---|---|---|---|---|
| 4,562,382 | A | 12/1985 | Elliott | |
| 5,040,236 | A | 8/1991 | Costello | |
| 5,089,753 | A * | 2/1992 | Mattas | 315/324 |
| 5,416,387 | A * | 5/1995 | Cuk et al. | 315/209 R |
| 5,583,402 | A | 12/1996 | Moisin et al. | |
| 5,650,694 | A | 7/1997 | Jayaraman et al. | |
| 5,872,429 | A | 2/1999 | Xia et al. | |
| 6,369,461 | B1 | 4/2002 | Jungreis et al. | |
| 6,407,935 | B1 | 6/2002 | Chang et al. | |
| 7,812,550 | B2 | 10/2010 | Harmgardt et al. | |
| 8,067,902 | B2 | 11/2011 | Newman, Jr. et al. | |
| 8,212,491 | B2 * | 7/2012 | Kost et al. | 315/247 |
| 8,547,034 | B2 | 10/2013 | Melanson et al. | |
| 8,653,759 | B2 | 2/2014 | Vigh et al. | |
| 8,664,883 | B2 | 3/2014 | Hiramatu et al. | |
| 8,698,483 | B2 | 4/2014 | Riesebosch | |
| 8,716,957 | B2 | 5/2014 | Melanson et al. | |
| 8,723,431 | B2 | 5/2014 | Deppe et al. | |
| 8,742,674 | B2 | 6/2014 | Shteynberg et al. | |
| 8,928,243 | B2 | 1/2015 | Potter et al. | |
| 8,933,648 | B1 | 1/2015 | Putman et al. | |
| 9,167,664 | B2 | 10/2015 | Xie et al. | |
| 2003/0127994 | A1 | 7/2003 | Patchornik et al. | |
| 2003/0151931 | A1 | 8/2003 | Kohno | |
| 2005/0174162 | A1 | 8/2005 | Cheng et al. | |
| 2005/0249667 | A1 * | 11/2005 | Tuszynski et al. | 424/9.3 |
| 2006/0147371 | A1 * | 7/2006 | Tuszynski et al. | 424/1.11 |
| 2007/0040516 | A1 | 2/2007 | Chen | |
| 2007/0076459 | A1 | 4/2007 | Limpkin | |
| 2007/0262654 | A1 | 11/2007 | Mosebrook et al. | |
| 2007/0285028 | A1 | 12/2007 | Tsinker et al. | |
| 2008/0013343 | A1 | 1/2008 | Matthews | |
| 2008/0018261 | A1 * | 1/2008 | Kastner | 315/192 |
| 2008/0024074 | A1 | 1/2008 | Mosebrook et al. | |
| 2008/0119421 | A1 * | 5/2008 | Tuszynski et al. | 514/34 |
| 2008/0224636 | A1 | 9/2008 | Melanson | |
| 2009/0184652 | A1 | 7/2009 | Bollinger, Jr. et al. | |
| 2009/0184662 | A1 | 7/2009 | Given et al. | |
| 2009/0295292 | A1 | 12/2009 | Harmgardt et al. | |
| 2010/0013409 | A1 | 1/2010 | Quek et al. | |
| 2010/0141178 | A1 | 6/2010 | Negrete et al. | |
| 2010/0164406 | A1 | 7/2010 | Kost et al. | |
| 2010/0225251 | A1 | 9/2010 | Maruyama | |
| 2010/0244726 | A1 | 9/2010 | Melanson | |
| 2011/0012530 | A1 * | 1/2011 | Zheng et al. | 315/294 |
| 2011/0115400 | A1 | 5/2011 | Harrison et al. | |
| 2011/0121751 | A1 | 5/2011 | Harrison et al. | |
| 2011/0121752 | A1 | 5/2011 | Newman, Jr. et al. | |
| 2011/0121754 | A1 | 5/2011 | Shteynberg et al. | |
| 2011/0127925 | A1 | 6/2011 | Huang et al. | |
| 2011/0199017 | A1 | 8/2011 | Dilger | |
| 2011/0210674 | A1 | 9/2011 | Melanson | |
| 2011/0266968 | A1 | 11/2011 | Bordin et al. | |
| 2011/0309759 | A1 | 12/2011 | Shteynberg et al. | |
| 2012/0025729 | A1 | 2/2012 | Melanson et al. | |
| 2012/0043913 | A1 | 2/2012 | Melanson | |
| 2012/0049752 | A1 | 3/2012 | King et al. | |
| 2012/0098454 | A1 | 4/2012 | Grotkowski et al. | |
| 2012/0106216 | A1 | 5/2012 | Tzinker et al. | |
| 2012/0112638 | A1 | 5/2012 | Melanson et al. | |
| 2012/0112648 | A1 | 5/2012 | Hariharan | |
| 2012/0119669 | A1 * | 5/2012 | Melanson et al. | 315/247 |
| 2012/0139431 | A1 | 6/2012 | Thompson | |
| 2012/0146546 | A1 | 6/2012 | Hu et al. | |
| 2012/0169240 | A1 | 7/2012 | MacFarlane | |
| 2012/0229041 | A1 | 9/2012 | Saes et al. | |
| 2012/0230073 | A1 | 9/2012 | Newman et al. | |
| 2012/0242238 | A1 | 9/2012 | Chen et al. | |
| 2012/0286684 | A1 * | 11/2012 | Melanson et al. | 315/224 |
| 2012/0286696 | A1 | 11/2012 | Ghanem | |
| 2012/0286826 | A1 | 11/2012 | King et al. | |
| 2012/0299501 | A1 | 11/2012 | Kost et al. | |
| 2013/0002163 | A1 | 1/2013 | He et al. | |
| 2013/0113458 | A1 | 5/2013 | Riesebosch | |
| 2013/0278159 | A1 | 10/2013 | Del Carmen, Jr. et al. | |
| 2014/0009078 | A1 | 1/2014 | Xie et al. | |
| 2014/0009079 | A1 | 1/2014 | Xie et al. | |
| 2014/0009082 | A1 | 1/2014 | King et al. | |
| 2014/0167639 | A1 | 6/2014 | King et al. | |
| 2014/0167652 | A1 | 6/2014 | King et al. | |
| 2014/0239832 | A1 | 8/2014 | Shteynberg et al. | |
| 2014/0333205 | A1 | 11/2014 | Kost et al. | |
| 2015/0061536 | A1 | 3/2015 | Xie et al. | |

FOREIGN PATENT DOCUMENTS

| | | | |
|---|---|---|---|
| WO | 2011063205 | A1 | 5/2011 |
| WO | 2011111005 | A1 | 9/2011 |
| WO | 2013072793 | A1 | 5/2013 |
| WO | 2013090904 | A1 | 6/2013 |

OTHER PUBLICATIONS

International Search Report and Written Opinion, International Patent Application No. PCT/US2013/047844, mailed Jul. 23, 2014, 14 pages.

International Search Report and Written Opinion, International Patent Application No. PCT/US2014/032182, mailed Jul. 24, 2014, 10 pages.

International Search Report and Written Opinion, International Patent Application No. PCT/US2013/071690, mailed Jun. 4, 2014, 13 pages.

International Search Report and Written Opinion, International Patent Application No. PCT/US2014/037864, mailed Sep. 29, 2014, 8 pages.

International Search Report and Written Opinion, International Patent Application No. PCT/US2015/035052, mailed Oct. 21, 2015, 11 pages.

* cited by examiner 500
504
$V_{SUPPLY}$
DIMMER
502
$V_{\Phi_DIM}$
522
TRANSFORMER
$V_S$
BRIDGE
RECTIFIER
534
$i_{REC}$
$V_{REC}$
BOOST
STAGE
536
$V_{LINK}$
552
542
LAMP ASSEMBLY
512
CONTROLLER
BUCK
STAGE
538
$i_{OUT}$
$V_{out}$
554
532
LEDs

SYSTEMS AND METHODS FOR LOW-POWER LAMP COMPATIBILITY WITH A TRAILING-EDGE DIMMER AND AN ELECTRONIC TRANSFORMER

RELATED APPLICATIONS

The present disclosure claims priority as a continuation-in-part to U.S. patent application Ser. No. 13/798,926 filed Mar. 13, 2013, which claims priority to U.S. Provisional Patent Application Ser. No. 61/667,685, filed Jul. 3, 2012, and U.S. Provisional Patent Application Ser. No. 61/673,111, filed Jul. 18, 2012, all of which are incorporated by reference herein in their entirety.

The present disclosure also claims priority to U.S. Provisional Patent Application Ser. No. 61/826,250, filed May 22, 2013, which is incorporated by reference herein in its entirety.

FIELD OF DISCLOSURE

The present disclosure relates in general to the field of electronics, and more specifically to systems and methods for ensuring compatibility between one or more low-power lamps and the power infrastructure to which they are coupled.

BACKGROUND

Many electronic systems include circuits, such as switching power converters or transformers that interface with a dimmer The interfacing circuits deliver power to a load in accordance with the dimming level set by the dimmer For example, in a lighting system, dimmers provide an input signal to a lighting system. The input signal represents a dimming level that causes the lighting system to adjust power delivered to a lamp, and, thus, depending on the dimming level, increase or decrease the brightness of the lamp. Many different types of dimmers exist. In general, dimmers generate an output signal in which a portion of an alternating current ("AC") input signal is removed or zeroed out. For example, some analog-based dimmers utilize a triode for alternating current ("triac") device to modulate a phase angle of each cycle of an alternating current supply voltage. This modulation of the phase angle of the supply voltage is also commonly referred to as "phase cutting" the supply voltage. Phase cutting the supply voltage reduces the average power supplied to a load, such as a lighting system, and thereby controls the energy provided to the load. A particular type of phase-cutting dimmer is known as a trailing-edge dimmer A trailing-edge dimmer phase cuts from the end of an AC cycle, such that during the phase-cut angle, the dimmer is "off" and supplies no output voltage to its load, but is "on" before the phase-cut angle and in an ideal case passes a waveform proportional to its input voltage to its load.

FIG. 1 depicts a lighting system 100 that includes a trailing-edge, phase-cut dimmer 102 and a lamp 142. FIG. 2 depicts example voltage and current graphs associated with lighting system 100. Referring to FIGS. 1 and 2, lighting system 100 receives an AC supply voltage $V_{SUPPLY}$ from voltage supply 104. The supply voltage $V_{SUPPLY}$, indicated by voltage waveform 200, is, for example, a nominally 60 Hz/110 V line voltage in the United States of America or a nominally 50 Hz/220 V line voltage in Europe. Trailing edge dimmer 102 phase cuts trailing edges, such as trailing edges 202 and 204, of each half cycle of supply voltage $V_{SUPPLY}$. Since each half cycle of supply voltage $V_{SUPPLY}$ is 180 degrees of the supply voltage $V_{SUPPLY}$, the trailing edge dimmer 102 phase cuts the supply voltage $V_{SUPPLY}$ at an angle greater than 0 degrees and less than 180 degrees. The phase cut, input voltage $V_{\Phi_DIM}$ to lamp 142 represents a dimming level that causes the lighting system 100 to adjust power delivered to lamp 142, and, thus, depending on the dimming level, increase or decrease the brightness of lamp 142.

Dimmer 102 includes a timer controller 110 that generates dimmer control signal DCS to control a duty cycle of switch 112. The duty cycle of switch 112 is a pulse width (e.g., times $t_1-t_0$) divided by a period of the dimmer control signal (e.g., times $t_3-t_0$) for each cycle of the dimmer control signal DCS. Timer controller 110 converts a desired dimming level into the duty cycle for switch 112. The duty cycle of the dimmer control signal DCS is decreased for lower dimming levels (i.e., higher brightness for lamp 142) and increased for higher dimming levels. During a pulse (e.g., pulse 206 and pulse 208) of the dimmer control signal DCS, switch 112 conducts (i.e., is "on"), and dimmer 102 enters a low resistance state. In the low resistance state of dimmer 102, the resistance of switch 112 is, for example, less than or equal to 10 ohms. During the low resistance state of switch 112, the phase cut, input voltage $V_{\Phi_DIM}$ tracks the input supply voltage $V_{SUPPLY}$ and dimmer 102 transfers a dimmer current $i_{DIM}$ to lamp 142.

When timer controller 110 causes the pulse 206 of dimmer control signal DCS to end, dimmer control signal DCS turns switch 112 off, which causes dimmer 102 to enter a high resistance state (i.e., turns off). In the high resistance state of dimmer 102, the resistance of switch 112 is, for example, greater than 1 kiloohm. Dimmer 102 includes a capacitor 114, which charges to the supply voltage $V_{SUPPLY}$ during each pulse of the dimmer control signal DCS. In both the high and low resistance states of dimmer 102, the capacitor 114 remains connected across switch 112. When switch 112 is off and dimmer 102 enters the high resistance state, the voltage $V_C$ across capacitor 114 increases (e.g., between times $t_1$ and $t_2$ and between times $t_4$ and $t_5$). The rate of increase is a function of the amount of capacitance C of capacitor 114 and the input impedance of lamp 142. If effective input resistance of lamp 142 is low enough, it permits a high enough value of the dimmer current $i_{DIM}$ to allow the phase cut, input voltage $V_{\Phi_DIM}$ to decay to a zero crossing (e.g., at times $t_2$ and $t_5$) before the next pulse of the dimmer control signal DCS.

Dimming a light source with dimmers saves energy when operating a light source and also allows a user to adjust the intensity of the light source to a desired level. However, conventional dimmers, such as a trailing-edge dimmer, that are designed for use with resistive loads, such as incandescent light bulbs, often do not perform well when supplying a raw, phase modulated signal to a reactive load such as a power converter or transformer, as is discussed in greater detail below.

FIG. 3 depicts a lighting system 100 that includes a trailing-edge, phase-cut dimmer 102, an electronic transformer 122, and a lamp 142. Such a system may be used, for example, to transform a high voltage (e.g., 110V, 220 V) to a low voltage (e.g., 12 V) for use with a halogen lamp (e.g., an MR16 halogen lamp). FIG. 4 depicts example voltage graphs associated with lighting system 101.

As is known in the art, electronic transformers operate on a principle of self-resonant circuitry. Referring to FIGS. 3 and 4, when dimmer 102 is used in connection with transformer 122 and a low-power lamp 142, the low current draw of lamp 142 may be insufficient to allow electronic transformer 122 to reliably self-oscillate.

To further illustrate, electronic transformer 122 may receive the dimmer output voltage $V_{\Phi_DIM}$ at its input where it is rectified by a full-bridge rectifier formed by diodes 124.

As voltage $V_{\Phi_DIM}$ increases in magnitude, voltage on capacitor 126 may increase to a point where diac 128 will turn on, thus also turning on transistor 129. Once transistor 129 is on, capacitor 126 may be discharged and oscillation will start due to the self-resonance of switching transformer 130, which includes a primary winding ($T_{2a}$) and two secondary windings ($T_{2b}$ and $T_{2c}$). Accordingly, as depicted in FIG. 4, an oscillating output voltage $V_s$ 400 will be formed on the secondary winding of transformer 132 and delivered to lamp 142 while dimmer 102 is on, bounded by an AC voltage level proportional to $V_{\Phi_DIM}$.

However, as mentioned above, many electronic transformers will not function properly with low-current loads. With a light load, there may be insufficient current through the primary winding of switching transformer 130 to sustain oscillation. For legacy applications, such as where lamp 142 is a 35-watt halogen bulb, lamp 142 may draw sufficient current to allow transformer 122 to sustain oscillation. However, should a lower-power lamp be used, such as a six-watt light-emitting diode (LED) bulb, the current drawn by lamp 142 may be insufficient to sustain oscillation in transformer 122, which may lead to unreliable effects, such as visible flicker and a reduction in total light output below the level indicated by the dimmer.

In addition, traditional approaches do not effectively detect or sense a type of transformer to which a lamp is coupled, further rendering it difficult to ensure compatibility between low-power (e.g., less than twelve watts) lamps and the power infrastructure to which they are applied.

SUMMARY

In accordance with the teachings of the present disclosure, certain disadvantages and problems associated with ensuring compatibility of a low-power lamp with a dimmer and a transformer may be reduced or eliminated.

In accordance with embodiments of the present disclosure, an apparatus may include a controller to provide compatibility between a load and a secondary winding of an electronic transformer. The controller may be configured to: (i) predict based on an electronic transformer secondary signal an estimated occurrence of a high-resistance state of a trailing-edge dimmer coupled to a primary winding of the electronic transformer, wherein the high-resistance state occurs when the trailing-edge dimmer begins phase-cutting an alternating current voltage signal; (ii) operate a power converter in a trailing-edge exposure mode for a first period of time immediately prior to the estimated occurrence of the high-resistance state, such that the power converter is enabled to transfer energy from the secondary winding to the load during the trailing-edge exposure mode; and (iii) operate the power converter in a power mode for a second period of time prior to and non-contiguous with the first period of time, such that the power converter is enabled to transfer energy from the secondary winding to the load during the power mode.

In accordance with these and other embodiments of the present disclosure, a method for providing compatibility between a load and a secondary winding of an electronic transformer may include: (i) predicting based on an electronic transformer secondary signal an estimated occurrence of a high-resistance state of a trailing-edge dimmer coupled to a primary winding of the electronic transformer, wherein the high-resistance state occurs when the trailing-edge dimmer begins phase-cutting an alternating current voltage signal; (ii) operating a power converter in a trailing-edge exposure mode for a first period of time immediately prior to the estimated occurrence of the high-resistance state, such that the power converter is enabled to transfer energy from the secondary winding to the load during the trailing-edge exposure mode; and (iii) operating the power converter in a power mode for a second period of time prior to and non-contiguous with the first period of time, such that the power converter is enabled to transfer energy from the secondary winding to the load during the power mode.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 5:
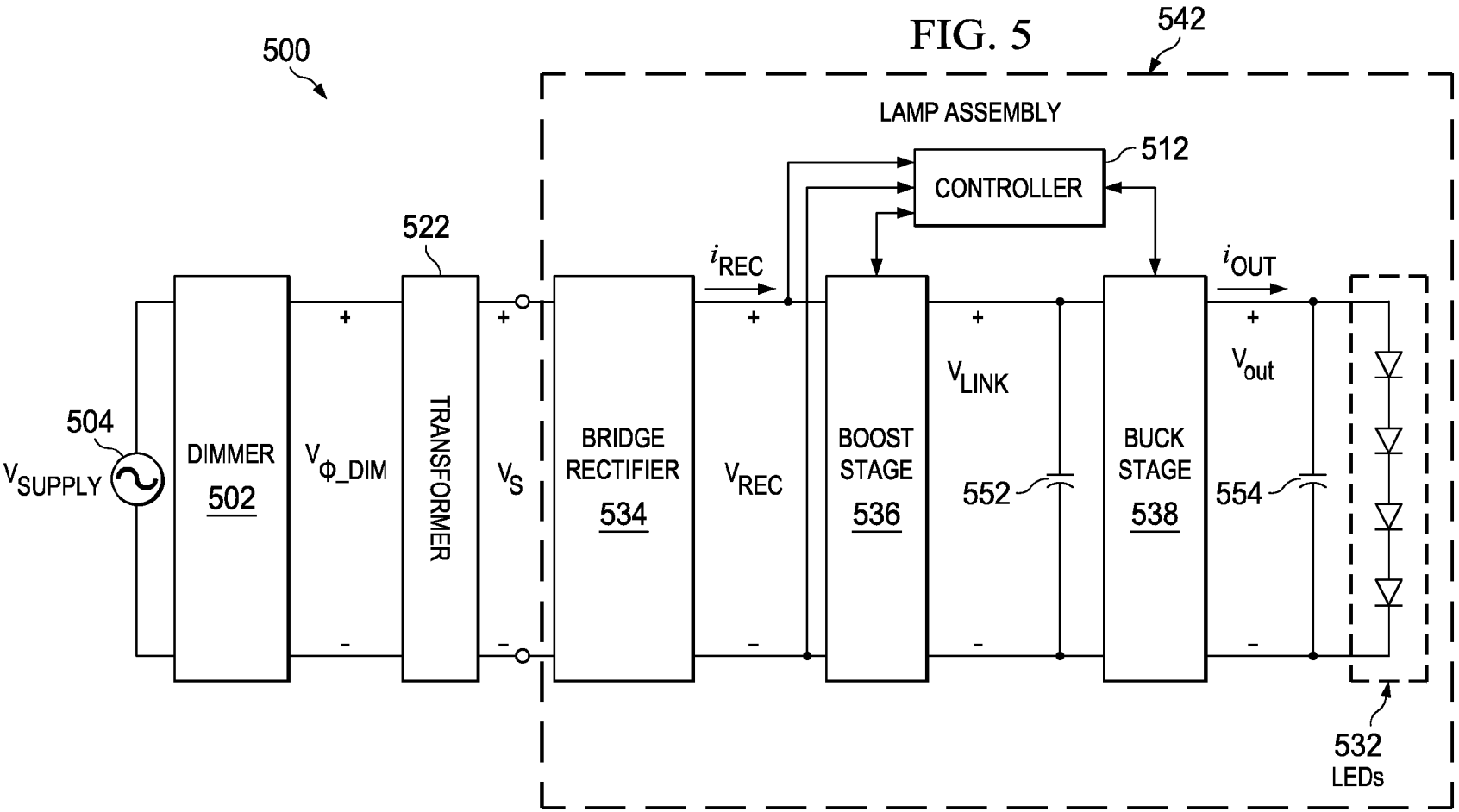
FIG. 5 illustrates an example lighting system including a controller for providing compatibility between a low-power lamp and an electronic transformer driven by a trailing-edge dimmer, in accordance with embodiments of the present disclosure.
Figure 6:
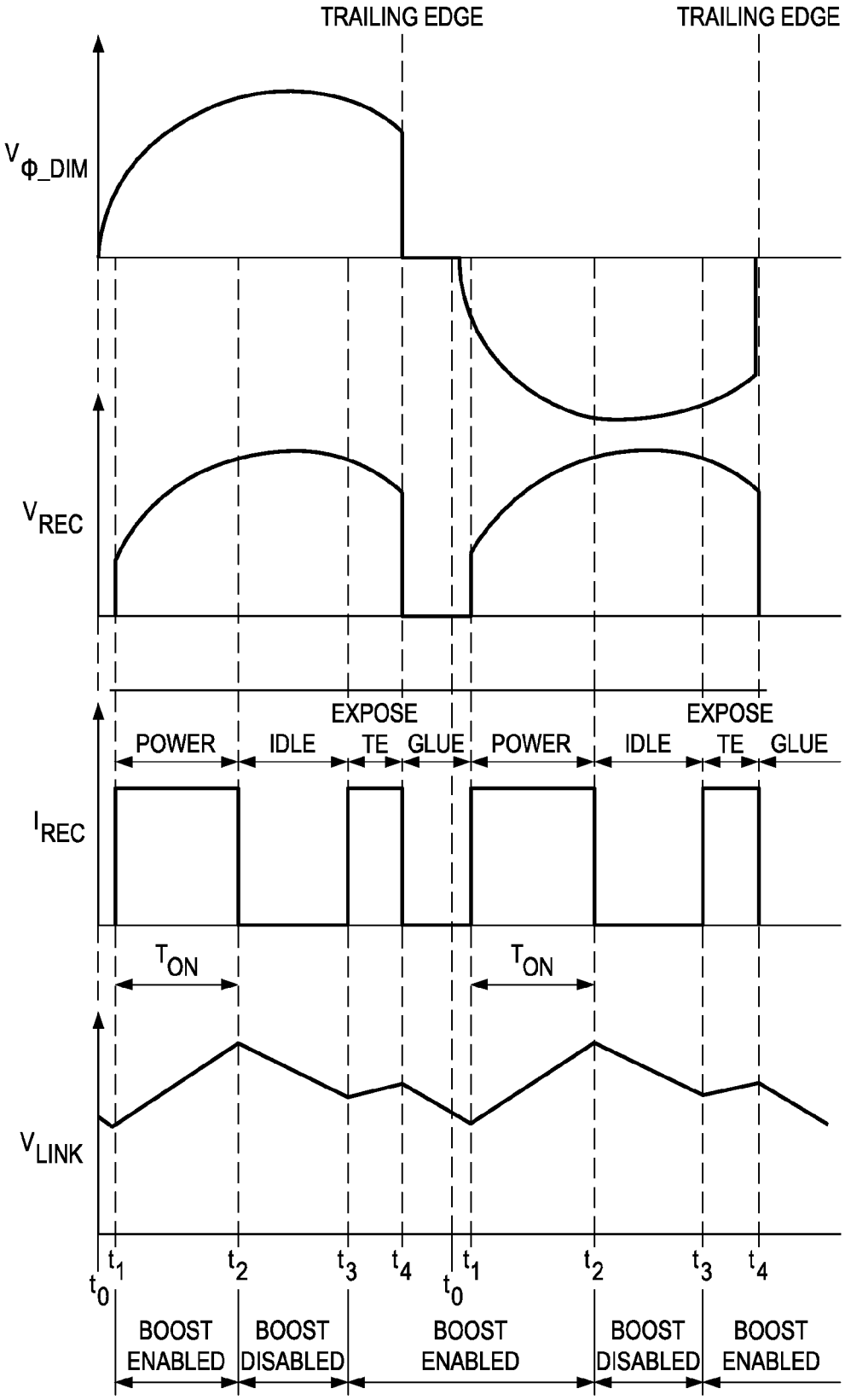
FIG. 6 depicts example voltage and current graphs associated with particular embodiments of the lighting system depicted in FIG. 5, in accordance with embodiments of the present disclosure.

FIG. 5 illustrates an example lighting system 500 including a controller 512 for providing compatibility between a low-power lamp 542 and other elements of a lighting system, in accordance with embodiments of the present disclosure. FIG. 6 depicts example voltage and current graphs associated with lighting system 500 depicted in FIG. 5, in accordance with embodiments of the present disclosure. As shown in FIG. 5, lightning system 500 may include a voltage supply 504, a dimmer 502, a transformer 522, a lamp 542, and a controller 512. Voltage supply 504 may generate a supply voltage $V_{SUPPLY}$ that is, for example, a nominally 60 Hz/110 V line voltage in the United States of America or a nominally 50 Hz/220 V line voltage in Europe.

Figure 1:
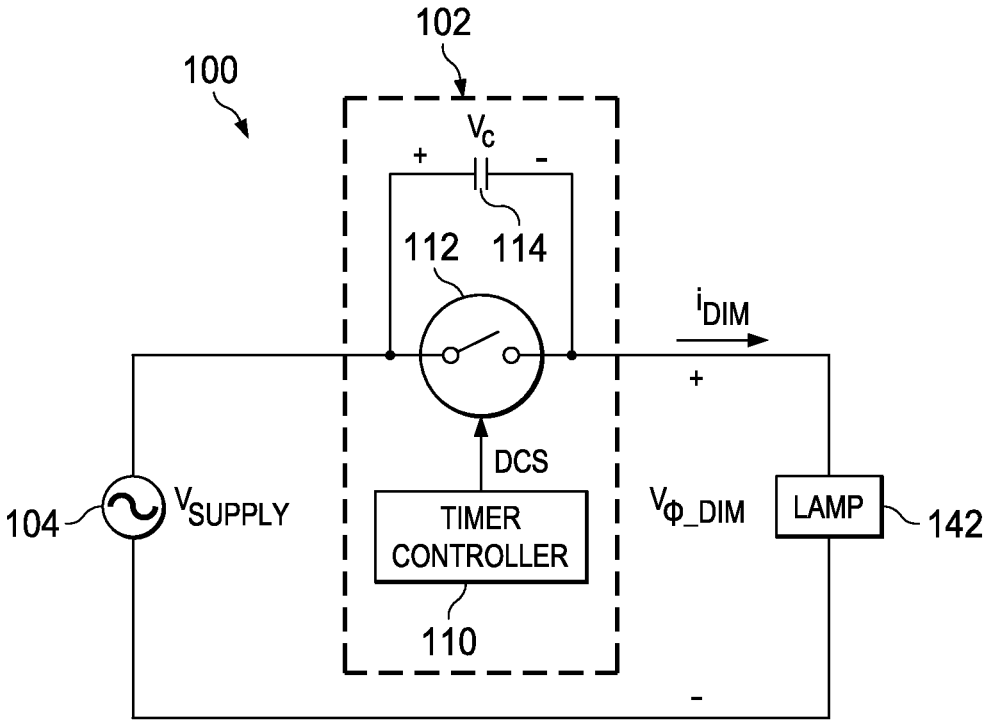
FIG. 1 (PRIOR ART)
FIG. 1 illustrates a lighting system that includes a phase-cut trailing-edge dimmer, as is known in the art.
Figure 3:
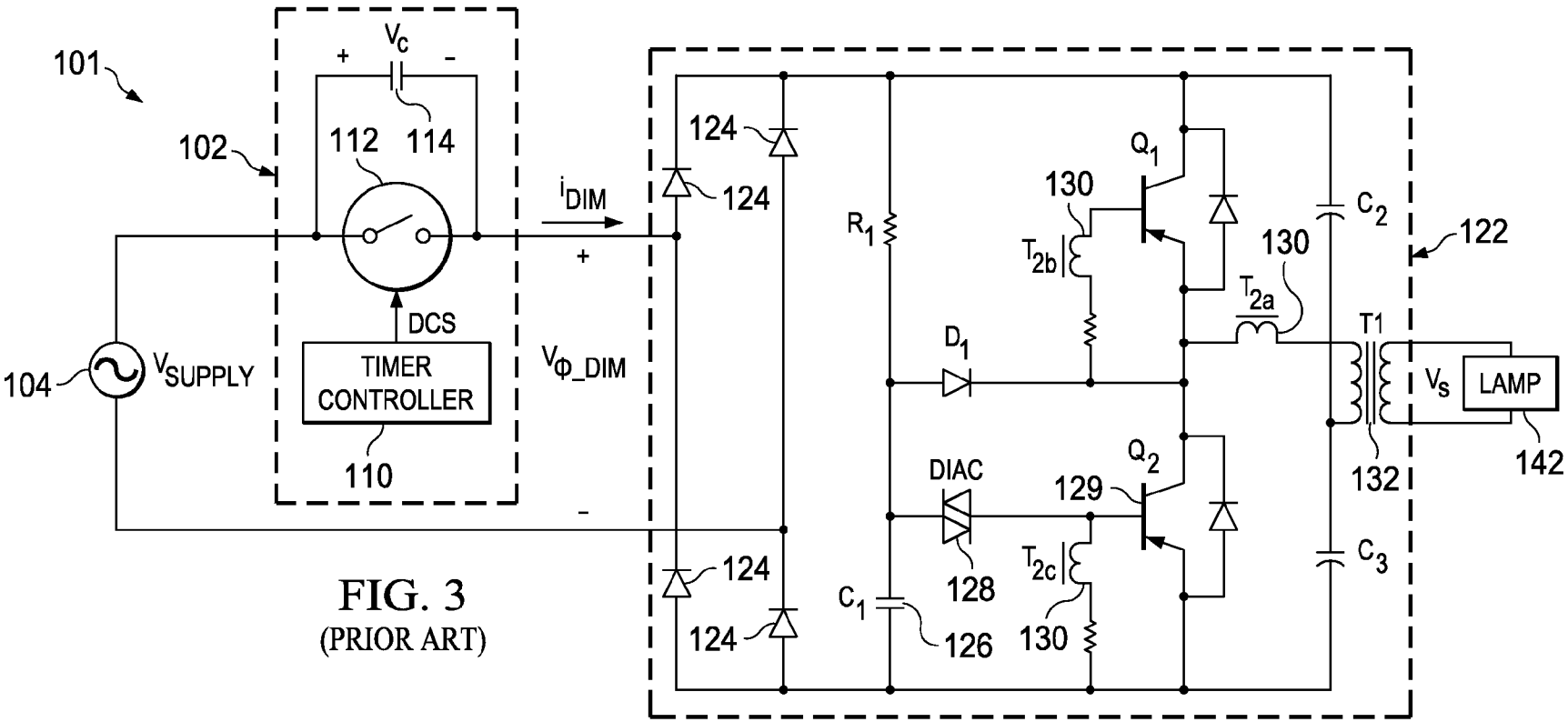
FIG. 3 (PRIOR ART)
FIG. 3 illustrates a lighting system that includes a phase-cut trailing-edge dimmer and an electronic transformer, as is known in the art.

Dimmer 502 may comprise any system, device, or apparatus for generating a dimming signal to other elements of lighting system 500, the dimming signal representing a dimming level that causes lighting system 500 to adjust power delivered to a lamp, and, thus, depending on the dimming level, increase or decrease the brightness of lamp 542. Thus, dimmer 502 may include a trailing-edge dimmer similar to that depicted in FIGS. 1 and 3, or any other suitable dimmer.

Transformer 522 may comprise any system, device, or apparatus for transferring energy by inductive coupling between winding circuits of transformer 522. Thus, transformer 522 may include an electronic transformer similar to that depicted in FIG. 3, or any other suitable transformer.

Lamp assembly 542 may comprise any system, device, or apparatus for converting electrical energy (e.g., delivered by electronic transformer 522) into photonic energy (e.g., at LEDs 532). In some embodiments, lamp assembly 542 may comprise a multifaceted reflector form factor (e.g., an MR16 form factor). In these and other embodiments, lamp assembly 542 may comprise an LED lamp. As shown in FIG. 5, lamp assembly 542 may include a bridge rectifier 534, a boost converter stage 536, a link capacitor 552, a buck converter stage 538, a load capacitor 554, and a controller 512.

Bridge rectifier 534 may comprise any suitable electrical or electronic device as is known in the art for converting the whole of alternating current voltage signal $v_s$ into a rectified voltage signal $v_{REC}$ having only one polarity.

Boost converter stage 536 may comprise any system, device, or apparatus configured to convert an input voltage (e.g., $v_{REC}$) to a higher output voltage (e.g., $v_{LINK}$) wherein the conversion is based on a control signal (e.g., a pulse-width modulated control signal communicated from controller 512). Similarly, buck converter stage 538 may comprise any system, device, or apparatus configured to convert an input voltage (e.g., $v_{LINK}$) to a lower output voltage (e.g., $v_{OUT}$) wherein the conversion is based on another control signal (e.g., a pulse-width modulated control signal communicated from controller 512).

Each of link capacitor 552 and output capacitor 554 may comprise any system, device, or apparatus to store energy in an electric field. Link capacitor 552 may be configured such that it stores energy generated by boost converter stage 536 in the form of the voltage $v_{LINK}$. Output capacitor 554 may be configured such that it stores energy generated by buck converter stage 538 in the form of the voltage $v_{OUT}$.

LEDs 532 may comprise one or more light-emitting diodes configured to emit photonic energy in an amount based on the voltage $V_{OUT}$ across the LEDs 532.

Controller 512 may comprise any system, device, or apparatus configured to, as described in greater detail elsewhere in this disclosure, determine one or more characteristics of voltage $v_{REC}$ present at the input of boost converter stage 536 and control an amount of current $i_{REC}$ drawn by the boost converter stage 536 based on such one or more characteristics of voltage $v_{REC}$. Operation of controller 512 may be described by reference to FIG. 6.

Figure 4:
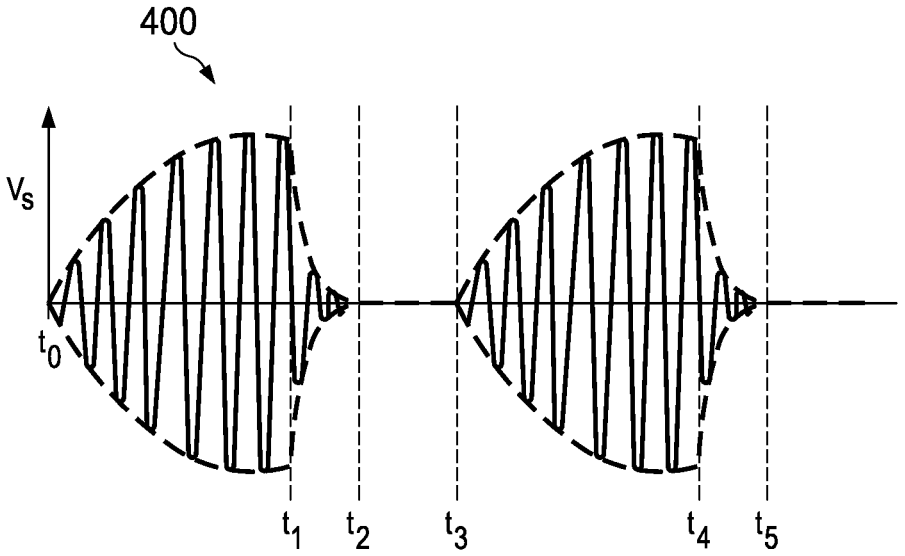
FIG. 4 (PRIOR ART)
FIG. 4 illustrates example voltage and current graphs associated with the lighting system depicted in FIG. 3, as is known in the art.
Figure 2:
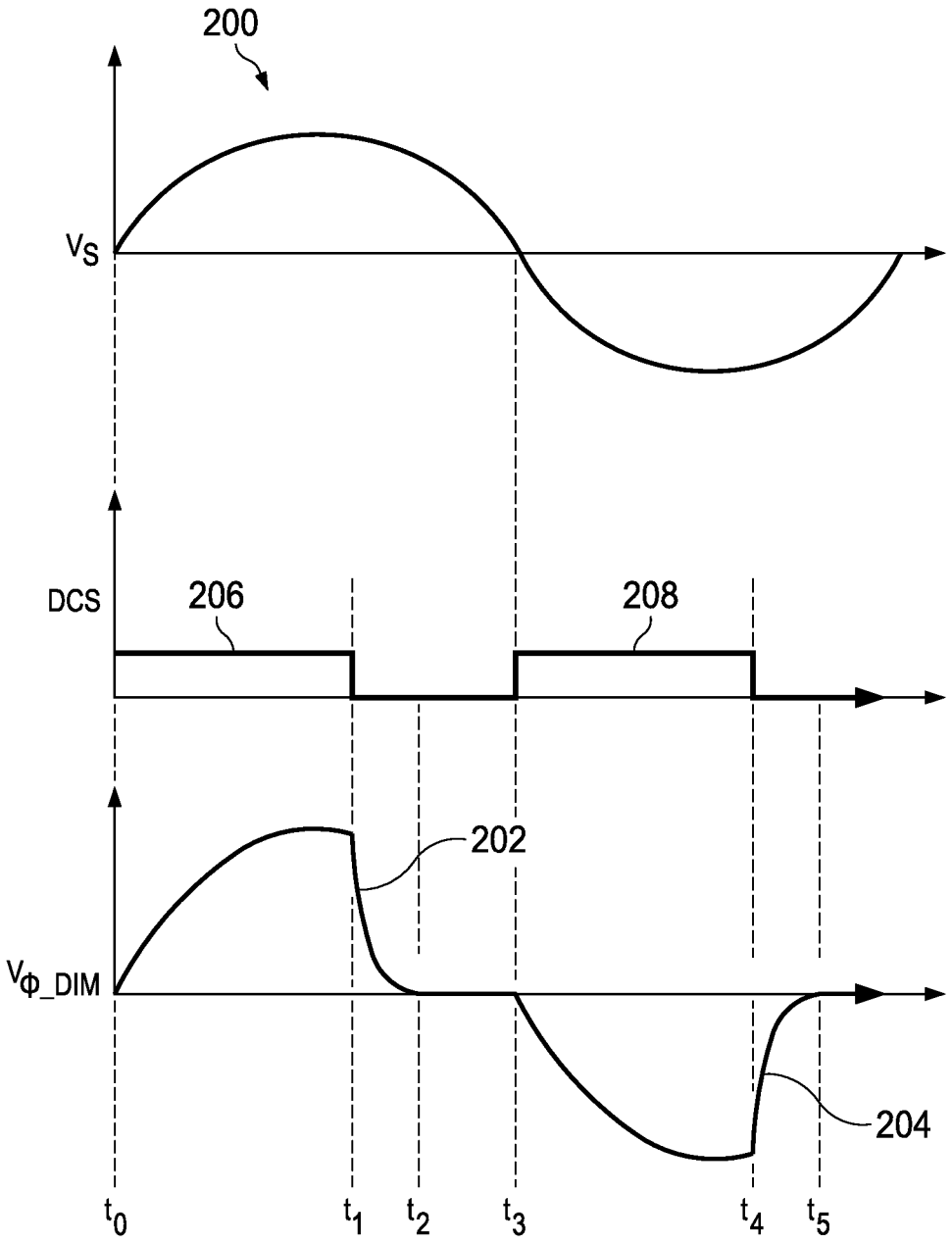
FIG. 2 (PRIOR ART)
FIG. 2 illustrates example voltage and current graphs associated with the lighting system depicted in FIG. 1, as is known in the art.

As previously described in reference to FIG. 4 in the Background section, an oscillating voltage $V_S$ of the secondary winding of electronic transformer 522 may be delivered to lamp assembly 542, wherein the oscillating voltage is bounded by the waveform $V_{\Phi_DIM}$ of the output of dimmer 502 depicted in FIG. 6, the trailing edge of dimmer 502 occurring at times $t_4$ shown in FIG. 6. Bridge rectifier 534 may in turn rectify transformer secondary voltage $V_S$, generating an oscillating rectified voltage $V_{REC}$ delivered to boost stage 536, wherein the oscillating voltage is bounded by the waveform $|V_{REC}|$ depicted in FIG. 6.

In operation, controller 512 may receive and analyze the rectified $V_{REC}$ to determine one or more characteristics of the rectified voltage $V_{REC}$. For example, controller 512 may be configured to detect an estimated occurrence of a positive edge of the $V_{REC}$ waveform occurring at time $t_1$ during each half-line cycle when electronic transformer 522 begins oscillating. Such positive edge may occur after the beginning (occurring at time $t_0$) of the half line cycle of the supply voltage $V_{SUPPLY}$ when the voltage $V_{\Phi_DIM}$ is large enough for electronic transformer 522 to charge its timer capacitor. As another example, controller 512 may be configured to detect an estimated occurrence of a negative edge of the $V_{REC}$ waveform occurring at time $t_3$ during each half-line cycle corresponding to the trailing edge of dimmer 502 output signal $V_{\Phi_DIM}$ (e.g., the estimated occurrence of the high-resistance state of dimmer 502). The estimated occurrence of the trailing edge/high-resistance state of dimmer 502 may be predicted in any suitable manner, for example, using systems and methods disclosed in U.S. patent application Ser. No. 13/298,002 filed Nov. 16, 2011 and entitled "Trailing Edge Dimmer Compatibility with Dimmer High Resistance Prediction," which is incorporated in its entirety herein for all purposes.

From such determination of the estimated occurrences of the positive edge and the negative edge, controller 512 may determine the estimated half-line cycle of supply voltage $V_{SUPPLY}$ (e.g., based on the difference between successive estimated occurrences of the positive edge), the estimated phase angle of dimmer 502 (e.g., based on the difference between an estimated occurrence of the positive edge and an estimated occurrence of a subsequent negative edge), and/or other characteristics of the rectified voltage $V_{REC}$. Thus, during each half-line cycle, controller 512 may use characteristics determined during the previous half-line cycle to control operation of map assembly 542.

Based on one or more of the characteristics of the rectified voltage $V_{REC}$ described above, controller 512 may sequentially operate boost stage 536 in a plurality of modes. For example, from approximately the estimated occurrence of the positive edge at time $t_1$ to a subsequent time $t_2$, controller 512 may operate in a high-current power mode in which it enables boost converter stage 536, allowing boost converter stage 536 to draw a substantially non-zero current $I_{REC}$ such that energy is transferred from electronic transformer 522 to link capacitor 552. The duration $T_{on}$ ($T_{on}=t_2-t_1$) of the power mode may be based on the estimated phase angle of dimmer 502 determined by controller 512.

Following the power mode, controller 512 may enter a low-current idle mode from time $t_2$ to time $t_3$ in which it disables boost converter stage 536 such that substantially no energy is delivered from electronic transformer 522 to link capacitor 552. Accordingly, during the idle mode, a small amount of ripple is present on link voltage $V_{LINK}$ and link capacitor 552 discharges to buck converter stage 538.

Following the idle mode, controller 512 may enter a high-current trailing-edge exposure mode in which it enables boost converter stage 536 from time $t_3$ to time $t_4$ to allow controller 512 to detect the negative edge. The time $t_3$ may occur at a period of time before a predicted occurrence of the negative edge (based on the determination of the estimated occurrence of the negative edge from the previous half-line cycle) and time $t_4$ may occur at the detection of the estimated occurrence of the negative edge. In some embodiments, the duration of time between $t_3$ and the predicted occurrence of the negative edge may remain constant, irrespective of the phase angle of dimmer 502. During the trailing-edge exposure mode, boost converter stage 536 may draw a substantially non-zero current $I_{REC}$ such that energy is transferred from electronic transformer 522 to link capacitor 552. Accordingly, controller 512 may control the cumulative durations of the power mode and the trailing-edge exposure mode such that the power delivered from electronic transformer 552 to lamp assembly 542 in each half-line cycle is commensurate with the control setting and phase-cut angle of dimmer 502.

Following the trailing-edge exposure mode, from time $t_4$ to the beginning of the subsequent power mode at time $t_1$ (e.g., at the estimated occurrence of the subsequent positive edge), controller 512 may enter a low-impedance glue mode in which it continues to enable boost converter stage 536, but substantially zero current $I_{REC}$ is delivered to boost converter stage 536, on account of the phase cut of dimmer 502 and a substantially zero voltage $V_{REC}$. The glue mode applies a low impedance to the secondary winding of electronic transformer 522, thus allowing discharge of any residual energy stored in the capacitors of dimmer 502 and/or electronic dimmer 522. After the trailing-edge exposure mode, controller 512 may again enter the power mode.

Although the foregoing discussion contemplates that controller 512 determines one of more characteristics of rectified voltage signal $V_{REC}$ in order to control operation of boost converter stage 536, in some embodiments controller 512 may control operation of boost converter stage 536 by receiving and analyzing the unrectified electronic transformer voltage $V_S$.

Figure 7:
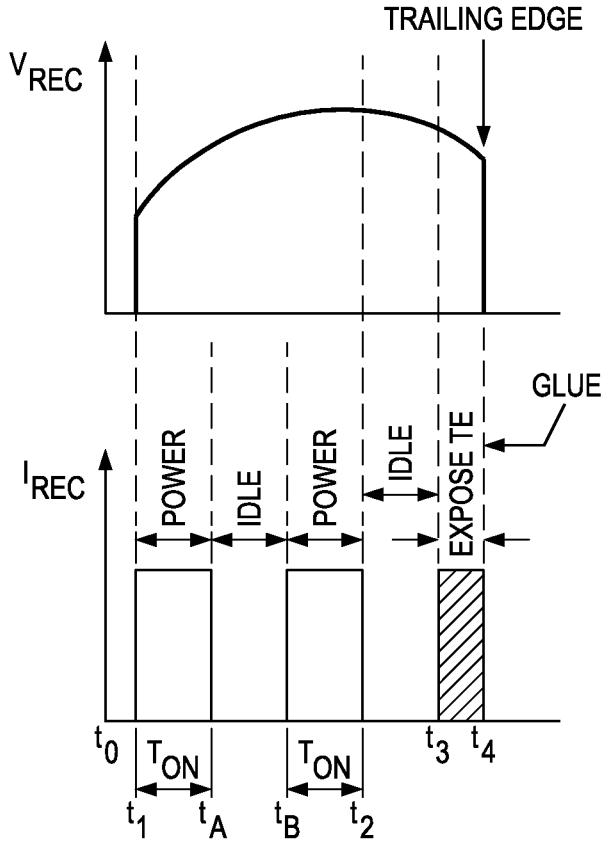
FIG. 7 depicts example voltage and current graphs associated with other particular embodiments of the lighting system depicted in FIG. 5, in accordance with embodiments of the present disclosure.

Although FIG. 6 and its accompanying discussion contemplate the existence of a single power mode per half-line cycle, in some embodiments controller 512 may employ a plurality of power modes per half-line cycle, as shown in FIG. 7 and described below. As shown in FIG. 7, from approximately the estimated occurrence of the positive edge at time $t_1$ to a subsequent time $t_A$, controller 512 may operate in a first power mode in which it enables boost converter stage 536, allowing boost converter stage 536 to draw a substantially non-zero current $I_{REC}$ such that energy is transferred from electronic transformer 522 to link capacitor 552. Following the first power mode, controller 512 may enter a first idle mode from time $t_A$ to time $t_B$ in which it disables boost converter stage 536 such that substantially no energy is delivered from electronic transformer 522 to link capacitor 552. After the first idle mode, from approximately time $t_B$ to a subsequent time $t_2$, controller 512 may operate in an additional power mode in which it enables boost converter stage 536, allowing boost converter stage 536 to draw a substantially non-zero current $I_{REC}$ such that energy is transferred from electronic transformer 522 to link capacitor 552. Following the additional power mode, controller 512 may enter an additional idle mode from time $t_2$ to time $t_3$ in which it disables boost converter stage 536 such that substantially no energy is delivered from electronic transformer 522 to link capacitor 552. Following the additional idle mode, controller 512 may enter a trailing-edge exposure mode in which is enables boost converter stage 536 from time $t_3$ to time $t_4$ to allow controller 512 to detect the negative edge. After the trailing-edge exposure mode, from time $t_4$ to the beginning of the subsequent power mode at time $t_1$ (e.g., at the estimated occurrence of the subsequent positive edge), controller 512 may enter a glue mode in which it continues to enable boost converter stage 536, but substantially zero current $I_{REC}$ is delivered to boost converter stage 536, on account of the phase cut of dimmer 502 and a substantially zero voltage $V_{REC}$.

Although FIG. 7 represents embodiments in which controller 512 enters two power modes during a single half-line cycle, in these and other embodiments controller 512 may have any positive number of power modes. In a half-line cycle with two or more power modes, the cumulative durations of the power modes in the half-line cycle may be based on the estimated phase angle of dimmer 502 determined by controller 512, such that cumulative durations of the power modes and the trailing-edge exposure mode are such that the power delivered from electronic transformer 552 to lamp assembly 542 in each half-line cycle is commensurate with the control setting and phase-cut angle of dimmer 502.

As used herein, when two or more elements are referred to as "coupled" to one another, such term indicates that such two or more elements are in electronic communication whether connected indirectly or directly, without or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. An apparatus comprising:

a controller to provide compatibility between a load and a secondary winding of an electronic transformer, wherein the controller is configured to:

predict based on an electronic transformer secondary signal an estimated occurrence of a high-resistance state of a trailing-edge dimmer coupled to a primary winding of the electronic transformer, wherein the high-resistance state occurs when the trailing-edge dimmer begins phase-cutting an alternating current voltage signal;

operate a power converter in a trailing-edge exposure mode for a first period of time immediately prior to the estimated occurrence of the high-resistance state, such that the power converter is enabled to transfer energy from the secondary winding to the load during the trailing-edge exposure mode; and operate the power converter in a power mode for a second period of time prior to and non-contiguous with the first period of time, such that the power converter is enabled to transfer energy from the secondary winding to the load during the power mode.

2. The apparatus of claim 1, wherein:

the controller is further configured to predict based on the electronic transformer secondary signal a control setting of the trailing-edge dimmer; and wherein the second period of time is based on the control setting.

3. The apparatus of claim 1, wherein the controller is further configured to predict based on an electronic transformer secondary signal an estimated occurrence of a beginning of oscillation of the electronic transformer; wherein the second period of time begins at approximately the estimated occurrence of the beginning of oscillation.

4. The apparatus of claim 1, wherein the controller is further configured to operate the power converter in a glue mode immediately after the first period of time, such that the power converter provides a low input impedance during the glue mode.

5. The apparatus of claim 1, wherein the controller is further configured to operate the power converter in an idle mode between an end of the second period of time and a beginning of the first period of time, such that the power converter is disabled from transferring energy from the secondary winding to the load during the idle mode.

6. The apparatus of claim 5, wherein the controller is further configured to operate the power converter in a glue mode immediately after the first period of time, such that the power converter provides a low input impedance during the glue mode.

7. The apparatus of claim 6, wherein the controller is further configured to sequentially and cyclically operate in the power mode, the idle mode, the first trailing-edge exposure mode, and the glue mode.

8. The apparatus of claim 1, wherein the controller is configured to operate in a second power mode for a third period of time between the first period of time and second period of time and non-contiguous to the second period of time, such that the power converter is enabled to transfer energy from the secondary winding to the load during the second power mode.

9. The apparatus of claim 8, wherein the third period of time is non-contiguous to the first period of time.

10. The apparatus of claim 8, wherein:

the controller is further configured to predict based on the electronic transformer secondary signal a control setting of the trailing-edge dimmer; and the cumulative duration of the second period of time and the third period of time are based on the control setting.

11. The apparatus of claim 1, wherein the load comprises a lamp.

12. The apparatus of claim 11, wherein the lamp comprises a light-emitting diode lamp.

13. The apparatus of claim 11, wherein the lamp further comprises a multifaceted reflector form factor.

14. A method for providing compatibility between a load and a secondary winding of an electronic transformer comprising:

predicting based on an electronic transformer secondary signal an estimated occurrence of a high-resistance state of a trailing-edge dimmer coupled to a primary winding of the electronic transformer, wherein the high-resistance state occurs when the trailing-edge dimmer begins phase-cutting an alternating current voltage signal;

operating a power converter in a trailing-edge exposure mode for a first period of time immediately prior to the estimated occurrence of the high-resistance state, such that the power converter is enabled to transfer energy from the secondary winding to the load during the trailing-edge exposure mode; and operating the power converter in a power mode for a second period of time prior to and non-contiguous with the first period of time, such that the power converter is enabled to transfer energy from the secondary winding to the load during the power mode.

15. The method of claim 14, further comprising predicting based on the electronic transformer secondary signal a control setting of the trailing-edge dimmer, and wherein the second period of time is based on the control setting.

16. The method of claim 14, further comprising predicting based on an electronic transformer secondary signal an estimated occurrence of a beginning of oscillation of the electronic transformer; wherein the second period of time begins at approximately the estimated occurrence of the beginning of oscillation.

17. The method of claim 14, further comprising operating the power converter in a glue mode immediately after the first period of time, such that the power converter provides a low input impedance during the glue mode.

18. The method of claim 14, further comprising operating the power converter in an idle mode between an end of the second period of time and a beginning of the first period of time, such that the power converter is disabled from transferring energy from the secondary winding to the load during the idle mode.

19. The method of claim 18, further comprising operating the power converter in a glue mode immediately after the first period of time, such that the power converter provides a low input impedance during the glue mode.

20. The method of claim 19, further comprising sequentially and cyclically operating in the power mode, the idle mode, the trailing-edge exposure mode, and the glue mode.

21. The method of claim 14, further comprising operating in a second power mode for a third period of time between the first period of time and the second period of time and non-contiguous to the second period of time, such that the power converter is enabled to transfer energy from the secondary winding to the load during the second power mode.

22. The method of claim 21, wherein the third period of time is non-contiguous to the first period of time.

23. The method of claim 21, further comprising predicting based on the electronic transformer secondary signal a control setting of the trailing-edge dimmer, and wherein the cumulative duration of the second period of time and the third period of time are based on the control setting.

24. The method of claim 14, wherein the load comprises a lamp.

25. The method of claim 24, wherein the lamp comprises a light-emitting diode lamp.

26. The method of claim 24, wherein the lamp comprises a multifaceted reflector form factor.

* * * * *